US007575665B2

(12) United States Patent
Harrington et al.

(10) Patent No.: US 7,575,665 B2
(45) Date of Patent: Aug. 18, 2009

(54) METHOD OF REDUCING CORROSION OF SILVER CONTAINING SURFACES

(75) Inventors: Charles R. Harrington, Troy, MI (US); Neil R. Aukland, Sterling Heights, MI (US)

(73) Assignee: Delphi Technologies, Inc., Troy, MI (US)

( * ) Notice: Subject to any disclaimer, the term of this patent is extended or adjusted under 35 U.S.C. 154(b) by 477 days.

(21) Appl. No.: 11/116,509

(22) Filed: Apr. 28, 2005

(65) Prior Publication Data

US 2006/0246313 A1 Nov. 2, 2006

(51) Int. Cl.
*C25D 3/00* (2006.01)
*C25D 3/46* (2006.01)
*C25D 3/56* (2006.01)

(52) U.S. Cl. ..... 205/238; 205/261; 205/263

(58) Field of Classification Search ..... 205/238, 205/316, 261, 263

See application file for complete search history.

(56) References Cited

U.S. PATENT DOCUMENTS

| | | | | |
|---|---|---|---|---|
| 1,779,809 | A | 10/1930 | Gray et al. | |
| 1,850,997 | A | 3/1932 | Assmann | |
| 1,947,180 | A | 2/1934 | Blasius | |
| 2,682,593 | A * | 6/1954 | Jenny | 200/267 |
| 3,687,713 | A | 8/1972 | Adams | |
| 4,153,519 | A * | 5/1979 | Suzuki et al. | 205/176 |
| 4,269,671 | A | 5/1981 | Cohen et al. | |
| 4,303,480 | A | 12/1981 | Wood et al. | |
| 4,578,215 | A | 3/1986 | Bradley | |
| 4,628,165 | A | 12/1986 | Nobel et al. | |
| 4,822,641 | A | 4/1989 | Weik | |
| 5,500,304 | A | 3/1996 | Luffler et al. | |
| 5,614,327 | A | 3/1997 | Morello | |
| 5,800,932 | A | 9/1998 | Suzuki et al. | |
| 6,207,035 | B1 | 3/2001 | Adler et al. | |
| 6,254,979 | B1 | 7/2001 | Drew et al. | |
| 6,653,842 | B2 * | 11/2003 | Mosley et al. | 324/446 |
| 6,755,958 | B2 | 6/2004 | Datta | |

FOREIGN PATENT DOCUMENTS

JP 55079892 A * 6/1980

OTHER PUBLICATIONS

Lien et al., "Study of the Mechanism and Kinetics of Cathodic Reactions with a Silver Electrode in a 0.1N Potassium Iodide Solution", Tap Chi Hoa Hoc (no month, 1978), vol. 16, No. 1, pp. 9-13. Abstract Only.*

Lien et al., "Study of the Mechanism and Kinetics of Cathodic Reactions with a Silver Electrode in a 0.1N Potassium Iodide Solution", Tap Chi Hoa Hoc (no month, 1978), vol. 16, No. 1, pp. 9-13. English Translation.*

(Continued)

*Primary Examiner*—Edna Wong
(74) *Attorney, Agent, or Firm*—Thomas N. Twomey

(57) ABSTRACT

Described is a method of reducing corrosion of a silver-containing surface comprising electro-depositing a layer of an iodine-containing material on the silver-containing surface at a charge density of about 80 mA*s (milliamps second)/cm$^2$ or less. Also described is an electrical contact also produced by the method.

10 Claims, 1 Drawing Sheet

OTHER PUBLICATIONS

Lien et al., "Study of the Mechanism and Kinetics of Cathodic Reactions with a Silver Electrode in a 0.1N Potassium Iodide Solution", Tap Chi Hoa Hoc (no month, 1978), vol. 16, No. 1, pp. 9-13.*

Watanabe et al., "Micro-Structure of Electrodeposited Ag Film From Iodine Silver Bath", J. Japan Inst. Metals, vol. 66, No. 6 (no month, 2002), pp. 614-620.*

Ashiru et al., "Kinetics of Reduction of Silver Complexes at a Rotating Disk Electrode", J. Electrochem. Soc., vol. 139, No. 10, Oct. 1992, pp. 2806-2810.*

Bukharova et al., "Kinetics of Cathodic Reduction of Silver Ions in an Iodide Solution", Zhurnal Prikladnoi Khimii (Sankt-Peterburg, Russian Federation) (no month, 1986), vol. 59, No. 10, pp. 2306-2309. Abstract Only—1 page.*

Bukharova et al., "Kinetics of Cathodic Reduction of Silver ions in an Iodide Solution", Zhurnal Prikladnoi Khimii (Sankt-Peterburg, Russian Federation) (no month, 1986), vol. 59, No. 10, pp. 2306-2309. Full Document.*

* cited by examiner

METHOD OF REDUCING CORROSION OF SILVER CONTAINING SURFACES

FIELD OF THE INVENTION

The present invention relates generally to treatment of silver-containing surfaces, and more particularly, to a method of treating silver-containing surfaces to reduce corrosion.

BACKGROUND OF THE INVENTION

Electrical terminals are commonly made from a copper-containing base material that may have a conductive coating thereon. Silver is often used as the coating material for the copper base metal for high temperature applications. However, the silver-containing surface may be undesirably corrodible and have friction and wear characteristics that hinder its effective use especially in electrical terminals for automotive applications. The silver-coated terminals react with sulfur-containing substances by tarnishing or by forming bridges between terminals that are made of silver corrosion by-products, which can change the electrical characteristics of terminals and their circuits.

Silver iodide has been used as a solid lubricant layer for power contacts in an on-load tap changer, which is an electromechanical device installed on a power transformer to regulate the voltages of the transformer under load. IEEE, 2001, PP239-244.

Thus, it is an object of the present invention to provide an electrical contact or terminal having silver-containing surfaces having reduced corrosion and is economical and efficient for mass-production.

SUMMARY OF THE INVENTION

The invention pertains to a method of reducing corrosion of a silver-containing surface comprising electro-depositing a layer of an iodine-containing material on said silver surface at a charge density of about 80 mA*s (milliamp second)/cm$^2$ or less.

Another embodiment is an electrical contact comprising, a base material; a silver-containing material coated on said base material; and an iodine-containing material electro-deposited on said silver-containing material, wherein said iodine-containing material reduces corrosion of said silver-containing material and wherein the electrical contact has a contact resistance at 1 N contact force of about 100 mΩ (milliohms) or less after exposure to temperatures of about 200° C. or less.

These and other objects and advantages of this invention will become apparent from a detailed description of the invention as follows.

BRIEF DESCRIPTION OF THE DRAWINGS

The present invention will now be described, by way of example, with reference to the accompanying drawings, in which.

DETAILED DESCRIPTION OF THE INVENTION

Figure 1:
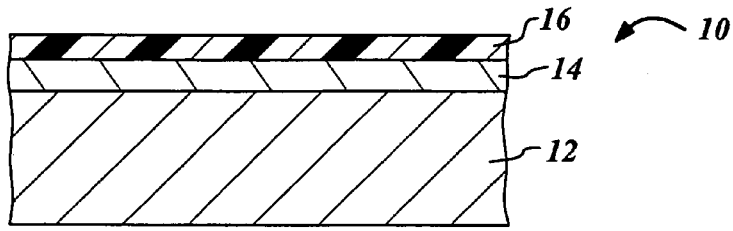
FIG. 1 is a schematic cross-sectional view of an electrical contact according to the present invention.

With reference now to the drawings, FIG. 1 illustrates an enlarged portion of an electrical contact 10 including a base metal layer or substrate 12 having a conductive silver-containing material layer 14 coated thereon. The silver-containing layer 14 is protected from tarnishing and corrosion when subjected to sulfur-containing atmospheres by electro-depositing iodide into the silver resulting in a thin layer of silver iodide 16 on the silver coating 14. While applicant does not wish to be bound to any particular theory, it is believed that during the electro-deposition process, the iodide ion is attracted to the positive electrode comprised of silver and a reaction takes place to form silver iodide (AgI). The silver iodide layer 16 permits the electrical resistance of the surface to remain below 100 milliohm (mΩ) at 1 Newton (N) normal contact force made with negligible or no sliding or wiping motion permitted during the measurement near 20° C., even after extended durations of exposure at 200° C., thereby ensuring a suitably low resistance electrical contact to the underlying silver layer 14. Use of a protective iodine-containing coating on the surface of a silver-containing layer is particularly useful in contact, terminal, switch and other electrical connector applications.

The base metal layer or substrate 12 is generally made of a relatively inexpensive conductive metal, such as aluminum, zinc, copper, tin, stainless steel, or other metals or alloys thereof commonly used for electrical contact applications as known to one skilled in the art. For descriptive purposes, the base layer 12 is a copper alloy. Oxidation and/or corrosion of the base metal layer 12 causes the base metal to corrode or form electrically resistive or non-conductive layers thereon. These effects are mitigated by electro-plating or otherwise bonding a conductive metal, such as nickel, tin or precious metal, such as, silver, gold, platinum, palladium, or alloys thereof on the base layer 12 to form the conductive metal layer 14. Such metals provide reliable and stable interconnections between electrical contacts of electromechanical devices. For such conductive layers coated with silver or a silver alloy, however, exposure to sulfur-containing atmospheres will most likely cause tarnishing that can cause dramatic changes in appearance of the silver-containing surface from the nominal appearance expected. More severe corrosion of the silver metal by sulfur-containing compounds can excessively increase the electrical resistance of the surface, thereby weakening the effective conductive function of the silver-containing electrical contact layer.

As shown in FIG. 1, tarnishing or corrosion may be mitigated or even completely eliminated by electroplating an extremely thin layer of silver iodide on the silver layer 14, wherein the iodide layer 16 is thick enough to just cover the surface of the conductive layer 14. An electroplating or electro-depositing process preferably forms the iodide layer 16 where the deposition of iodine on the conductive layer 14 may suitably be controlled. An uncontrolled deposition of the iodine leads to discoloration of the silver surface. For example, if a higher than suitably necessary electrical charge density is used during the electro-plating process, a dark gray iodized layer will form, tending to have unacceptably high surface resistance and an undesirable appearance. Preferably, a light gray iodized layer should be formed because it effectively resists discoloration of the silver layer 14 from exposure to sulfur.

In accordance with the present invention, the deposition of iodine on the surface of the conductive layer 14 was controlled by varying several electro-plating parameters to produce test coupons with different surface resistance and wear characteristics. The test coupons were silver-plated strips cut in lengths of about 1.5 inches wide; a size normally used for various terminal designs. The coupons were then cut in lengths of about 2 inches (corresponding to an area of about 20 $cm^2$ per side) and ultrasonically cleaned in a degreaser, such as trichloroethylene, before applying acetone and isopropyl alcohol rinses to the coupons. Samples were dried with compressed nitrogen before electrical connection to an electroplating apparatus.

The coupons were then coated with iodine using a DC voltage supply and a platinum electrode in an aqueous solution of potassium iodide (KI) at room temperature. The base metal substrate was the positive terminal and the iodide formed onto the silver in the electrode. The KI concentrations evaluated were in the range of 0.05 to 5.00 g/L. Various combinations of voltage, current and time were evaluated with the test coupon positioned about 3 inches from the platinum electrode, each at opposing sides of a circular beaker containing about 240 mL of plating solution, minimally agitated using a stirring bar.

The results of the several coupons tested tend to show that electro-deposition of iodine on silver initially forms a yellow silver iodide surface coating. The silver iodide surface turns gray within hours when exposed to air and may be unacceptably dark if excessive plating charge density is used. Also, the resistance of the iodized surface increases with plating charge density and is controllable using current density and time to maintain an acceptable maximum surface resistance of about 100 mΩ and more closely to about 5 mΩ.

The gray iodized surface layer is characterized by measuring the electrical resistance of the surface in contact with a hemispherical gold probe tip, of radius 1.6 mm. An acceptable contact resistance is below a level at which the resistance of the electrical contact within a circuit impairs the function of the circuit to an extent that the circuit ceases to function as desired. Using a maximum acceptable resistance value of 10 mΩ occurs near 40 mA*s/$cm^2$, however higher levels of resistance may be acceptable, depending on the application. For example, in high current automotive applications, an acceptable contact resistance below 10 mΩ is advantageous, to reduce the joule heating effect that increases temperature at the contact and the rates of diffusion, corrosion and other phenomena associated with electrical contact failure. For low current application where joule heating is minimal, a much higher electrical contact resistance (100 mΩ or more) could be determined as acceptable. Therefore, an iodine layer formed using a plating charge density greater than about 40 mA*s/$cm^2$ may be utilized and still be acceptable.

A table of the plating parameters used and the surface resistances measured for 19 of the coupons iodized is shown in Table 1 for reference, compared to the average resistance of bare silver surfaces. A process number is shown in the left column for identification purposes, which corresponds to sequential processing of the coupons.

| Test Coupon Label | KI Conc. (g/l) | Plating Time (s) | Plating Voltage (V) | Plating Current (mA) | Current Density (mA/cm2) | Charge Density (mA * s/cm2) | Coupon Charge (A * s) | Coupon Resistance (Ohm)(Ω) |
|---|---|---|---|---|---|---|---|---|
| 0 | | bare silver surface | | | | | | 0.000746 |
| 7 | 0.50 | 60 | 0.25 | 0.250 | 0.013 | 0.78 | 0.0150 | 0.000693 |
| 8 | 0.50 | 30 | 0.53 | 0.500 | 0.026 | 0.78 | 0.0150 | 0.000647 |
| 9 | 0.50 | 15 | 1.06 | 1.000 | 0.052 | 0.78 | 0.0150 | 0.000677 |
| 6 | 0.50 | 60 | 0.90 | 1.000 | 0.052 | 3.10 | 0.0600 | 0.000758 |
| 3 | 0.05 | 300 | 3.00 | 0.715 | 0.037 | 11.08 | 0.2145 | 0.000903 |
| 5 | 0.50 | 60 | 3.00 | 3.600 | 0.186 | 11.16 | 0.2160 | 0.00123 |
| 4 | 0.05 | 600 | 3.00 | 0.625 | 0.032 | 19.38 | 0.3750 | 0.00109 |
| 19 | 0.50 | 300 | 1.05 | 1.250 | 0.065 | 19.38 | 0.3750 | 0.00127 |
| 10 | 0.50 | 232 | 1.93 | 2.500 | 0.129 | 29.97 | 0.5800 | 0.00106 |
| 13 | 0.50 | 216 | 2.68 | 3.000 | 0.155 | 33.48 | 0.6480 | 0.00203 |
| 18 | 0.50 | 216 | 2.37 | 3.000 | 0.155 | 33.48 | 0.6480 | 0.00412 |
| 14 | 0.50 | 240 | 2.78 | 3.000 | 0.155 | 37.20 | 0.7200 | 0.00165 |
| 15 | 0.50 | 267 | 2.92 | 3.000 | 0.155 | 41.39 | 0.8010 | 0.00917 |
| 16 | 0.50 | 267 | 2.55 | 3.000 | 0.155 | 41.39 | 0.8010 | 0.00231 |
| 11 | 0.50 | 240 | 2.82 | 3.600 | 0.186 | 44.64 | 0.8640 | 0.0119 |
| 12 | 0.50 | 240 | 3.98 | 4.800 | 0.248 | 59.52 | 1.1520 | 0.0492 |
| 17 | 0.50 | 240 | 3.84 | 4.800 | 0.248 | 59.52 | 1.1520 | 0.0195 |
| 2 | 5.00 | 60 | 3.00 | 26.150 | 1.351 | 81.07 | 1.5690 | 0.0181 |
| 1 | 5.00 | 300 | 3.00 | 29.200 | 1.509 | 452.60 | 8.7600 | 15.6 |

Figure 2:
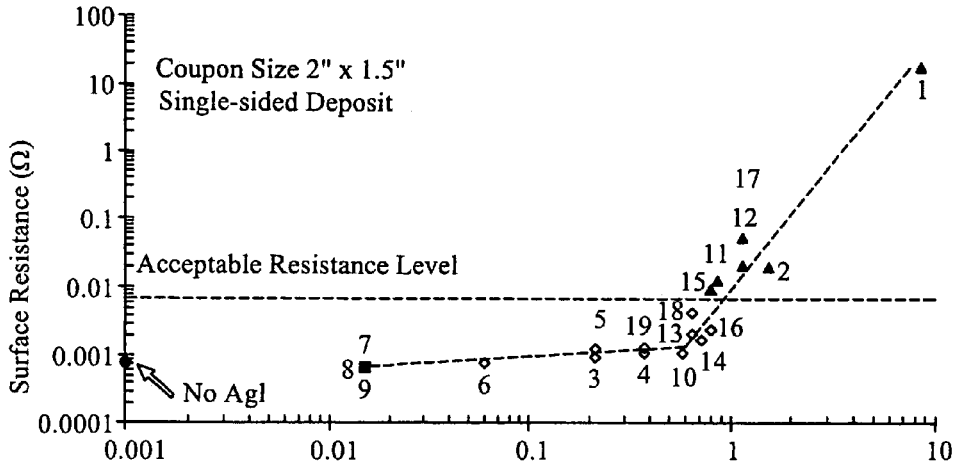
FIG. 2 is a graph of the total charge used per coupon plotted on a logarithmic scale along the x-axis with the average surface resistance of each coupon measured by the contact probe plotted logarithmically on the y-axis.

The surface resistance of the coupons listed in Table 1 increases with the total electrical charge used to deposit iodine onto each coupon surface, as shown in FIG. 2. The group of coupons, processed near charge levels of 0.01 A*s (sample numbers 7-9), had a negligible visible sign of silver iodide formation and was electrically similar to untreated silver surfaces (sample number 0). The group of coupons plated with iodine in the range about 0.08-0.80 A*s has resistances below a maximum acceptable level of about 5-10 mΩ. This upper limit is equivalent to a charge density of about 40 mA*s/$cm^2$. Charge densities below this limit resulted in AgI layer thicknesses of about 0.3 μm (micrometer) or less. The group of coupons iodized with a charge greater than about 0.8 A*s has resistances below a maximum acceptable level of about 100 mΩ (excepting only sample 1). Most of the coupons were prepared using a KI concentration of 0.5 g/L. At low electrolyte concentrations (0.05 g/L), relatively high voltage levels produce low plating current and required plating durations of five minutes or longer to produce visible AgI layers. Much higher KI concentrations (5.0 g/L) resulted in limited control of the plating charge per coupon, due to high current levels at low voltages for short plating durations.

Figure 3:
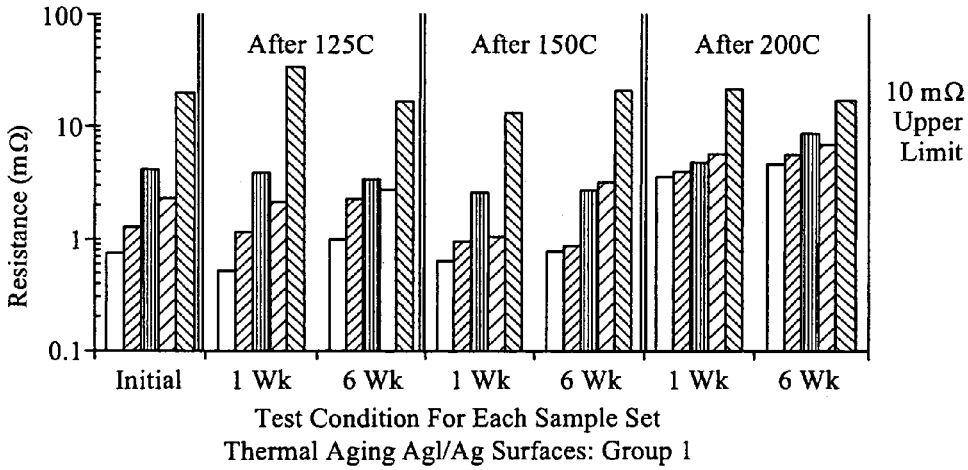
FIG. 3 is a graph showing the thermal aging comparison of different silver iodide/silver layers to bare silver surfaces.

Thermal aging was tested on the coupons and the results are presented in FIG. 3, comparing the average surface resistances of samples cut from passivated coupons (sample numbers 16-19) to bare coupons (sample number 0) after one and six weeks of continuous exposure to 125° C., 150° C. and 200° C. The graph legend indicates the five plating charge levels tested (0-1.5 A*s) in order of increasing charge per coupon, with the corresponding coupon number listed below each value. The resistance of a bare silver surface is shown as zero (0) plating charge per coupon.

The average of three measurements in different locations on each sample in each group is shown relative to an acceptable surface resistance limit of 10 mΩ. The average of the bare silver samples in all groups was before thermal aging initially about 0.75 mΩ. Only the samples iodized at about 1.15 A*s, cut from coupon sample number 17, exceeded the limit. The differences in surface resistance between the un-aged samples and those heat-aged for either duration at 125° C. or 150° C. are minimal in group 1. After both test durations at 200° C., the resistances of the bare silver surfaces were below 5 mΩ. The surface resistance of initially acceptable iodized surfaces also remained below a 10 mΩ limit.

The average surface resistance of the iodized surfaces decreased slightly after aging at 150° C. However, the initial resistance levels, measured on the group exposed to 125° C. for one week, were nearly identical to the separate group of un-aged samples. The average surface resistance of the coupon iodized at 0.65 A*s was initially about 1.5 mΩ higher than the resistance of the coupon iodized at 0.80 A*s. Minor resistance differences in the passivation layer in the areas probed and approximation of the total passivation charge may have caused this anomalous result.

A tarnish test involved exposing a separate group of three coupons to elemental sulfur, as prescribed in ASTM B 809-95. The bare silver coupon surface was brighter than the two silver surfaces that were iodized in the 0.5 g/L KI plating solution concentration at 15 mA*s/cm$^2$ and 30 mA*s/cm$^2$ charge density. Electrical surface resistance data was not collected prior to exposure of these coupons to sulfur vapors to prevent damage of the iodized surface layer. Electrical connection to them was made above the plating solution level in the upper right corner of the iodized coupons. The relative appearance of darker iodized silver surfaces is best compared to the bare silver surface in these regions.

A significant change in the appearance of the bare silver coupon was visibly obvious after 136 hours in the humid sulfur environment compared to the same iodized surfaces. The coupons were suspended above elemental sulfur in a plastic chamber that was placed in an oven at 50° C. The relative humidity was maintained near 80%, using the ASTM method. The bare silver surface tarnished to produce red and blue colored regions, with small, untarnished spots distributed across the surface of the coupon. Both of the iodized coupons exhibited negligible change in overall appearance, except in the bare upper-right regions that tarnished to black. A visual comparison of the coupons was used to gauge the corrosion sensitivity of the surfaces, since the resistance of all surfaces tarnish-tested remained below a 100 mΩ limit. Additional tarnish tests on samples cut from coupons iodized with less charge resulted in lighter initial appearances and also showed no surface discoloration after the test.

The benefits of an iodine containing layer on silver contact surfaces include significantly less tarnish sensitivity, sliding friction and wear, more fretting endurance, and equivalent thermal stability when compared to bare silver surfaces. The magnitudes of these benefits were estimated for iodized samples subjected to either mild corrosion conditions or when similarly iodized surfaces are worn against one another.

FIG. 2 is indicative of the silver iodide/silver layer by monitoring contact resistance to the sample surface. The silver iodide layer may not be free of defects or voids, which may contribute to permitting an acceptably low resistance contact to be exhibited by the surface at 1 N normal force. Alternatively, at any normal force, puncturing the silver iodide layer may be required to produce acceptably low resistance during usage. After wiping, for example in a terminal with as much as 20-30 N normal force, the layer can be penetrated and/or redistributed to still permit an acceptable contact resistance without removing all or part of the entire silver iodide layer first. The initial silver iodide thickness (charge transferred/area), like that produced on sample 1 in Table 1, may be excessive for an application that does not permit adequate sliding contact or sufficient normal force to produce a low contact resistance. Dissolving away all or part of the silver iodide layer, contacting the surfaces with a wiping motion and/or with sufficient normal force and the like can produce a desirable electrical contact like that produced in the other examples with the specific low resistance contact, without such post deposition aids.

The initial yellow iodized surface appearance is indicative of silver iodide. It is believed that the change to a gray surface appearance may be due to oxidation or be photo-chemically induced reactions. A change in crystal structure occurs at 146° C. from hexagonal for silver iodide (α) to cubic for silver iodide (β), which could affect corrosion properties at elevated temperatures. Iodized layers formed at 20 mA*s/cm$^2$ are about 0.3 μm thick or less.

The surface appearance may also be affected by the concentration of the KI plating solution used to iodize the Ag surface. Coupons iodized near 3V in the most dilute KI solutions prepared resulted in the lightest shade of gray appearance. The resulting surface texture may have been finer than that which resulted at significantly higher current densities and could have contributed to a lighter surface appearance.

While the invention has been described by reference to a specific embodiment, it should be understood that numerous changes may be made within the spirit and scope of the inventive concepts described. Accordingly, it is intended that the invention not be limited to the described embodiments, but will have full scope defined by the language of the following claims.

What is claimed is:

1. A method of reducing corrosion of a silver-containing surface comprising electro-depositing a layer of an iodine-containing material on said silver-containing surface at a charge density of about 80 mA*s (milliamp second)/cm$^2$ or less, wherein the electro-depositing said layer of said iodine-containing material comprises using an aqueous iodine solution having an iodide ion concentration of $3.0\times10^{-3}$ to $3.0\times10^{-2}$ mole/L.

2. The method of claim 1 wherein said charge density is at or below about 40 mA*s/cm$^2$.

3. The method of claim 1 wherein said iodine-containing material comprises a contact resistance of about 10 mΩ (milliohms) or less at 1N contact force after exposure to temperatures below about 200° C.

4. The method of claim 1 wherein said iodine-containing material comprises a contact resistance of about 100 mΩ (milliohms) or less at 1N contact force after exposure to temperatures below about 200° C.

5. The method of claim 1 wherein said iodine-containing material comprises a light gray color.

6. The method of claim 1 wherein the layer of the iodine-containing material has a thickness sufficient to cover the surface of said silver-containing surface.

7. The method of claim 1 wherein said aqueous iodine solution comprises KI.

8. A method as set forth in claim 1 wherein the iodine-containing material is electrodeposited to produce a layer consisting essentially of silver iodide over said silver-containing surface.

9. A method comprising:

providing an electrical contact comprising a base metal and a conductive silver-containing layer coated on the base metal; and electrodepositing a layer of an iodine-containing material on said silver-containing layer at a charge density of 80 mA* s/cm$^2$ or less, wherein said iodine-containing material is electrodeposited using an aqueous iodine solution comprising an iodide ion concentration of $3.0\times10^{-3}$ to $3.0\times10^{-2}$ mole/L, the electrodepositing being conducted for a sufficient time so that said iodine-containing material has a contact resistance at 1 N force of about 100 mΩ or less after exposure to temperatures of about 200° C or less.

10. A method as set forth in claim 9 wherein the iodine-containing material is electrodeposited to produce a layer consisting essentially of silver iodide over said silver-containing layer.

* * * * *